US008636166B2

(12) United States Patent
Lane

(10) Patent No.: US 8,636,166 B2
(45) Date of Patent: Jan. 28, 2014

(54) RESEALABLE BEVERAGE BOTTLE LID

(75) Inventor: Marvin Lane, Round Lake Beach, IL (US)

(73) Assignee: Thermos L.L.C., Schaumburg, IL (US)

( * ) Notice: Subject to any disclaimer, the term of this patent is extended or adjusted under 35 U.S.C. 154(b) by 338 days.

(21) Appl. No.: 12/983,994

(22) Filed: Jan. 4, 2011

(65) Prior Publication Data

US 2012/0168441 A1 Jul. 5, 2012

(51) Int. Cl.

| | |
|---|---|
| ***B65D 41/56*** | (2006.01) |
| ***B65D 51/18*** | (2006.01) |
| ***B65D 51/00*** | (2006.01) |
| ***B67D 3/00*** | (2006.01) |

(52) U.S. Cl.
USPC ..... 220/212; 220/254.8; 215/228; 222/505; 222/519; 222/549

(58) Field of Classification Search
USPC ..... 220/254.3, 254.4, 254.6, 254.8, 212, 220/287; 215/228; 222/505–507, 519–521, 222/548, 549, 568, 566
See application file for complete search history.

(56) References Cited

U.S. PATENT DOCUMENTS

| | | | | |
|---|---|---|---|---|
| 5,421,487 | A * | 6/1995 | Moretti | 222/153.1 |
| 5,713,493 | A * | 2/1998 | Garibaldi | 222/153.06 |
| 6,267,273 | B1 * | 7/2001 | Suzuki et al. | 222/505 |
| 7,677,421 | B2 * | 3/2010 | Lindsay | 222/521 |
| 7,832,600 | B2 * | 11/2010 | Lindsay | 222/521 |
| 2010/0288758 | A1 | 11/2010 | Blain | |

OTHER PUBLICATIONS

CamelBak Products LLC, web page showing Podium Chill beverage bottle and lid, Copyright 2011.

* cited by examiner

*Primary Examiner* — Steven A. Reynolds
*Assistant Examiner* — Javier A Pagan
(74) *Attorney, Agent, or Firm* — Schiff Hardin LLP

(57) ABSTRACT

A lid for a beverage bottle includes a lid body that is fastenable onto the bottle and an actuation dial that rotates on the lid body. The actuation dial rotates a rotating spout while permitting the spout to move axially by teeth sliding in channels. As the spout is rotated, it moves on threads within the lid body to provide the axial movement. A gasket within the spout bears against a plug of the lid body when the spout has been moved to the closed position. The gasket is free of the plug to form a fluid passageway from the bottle through the lid body and the spout when the spout has been moved to the open position. The gasket includes a seal ring bearing on a fluid flow tube of the lid body to prevent leaks.

15 Claims, 5 Drawing Sheets

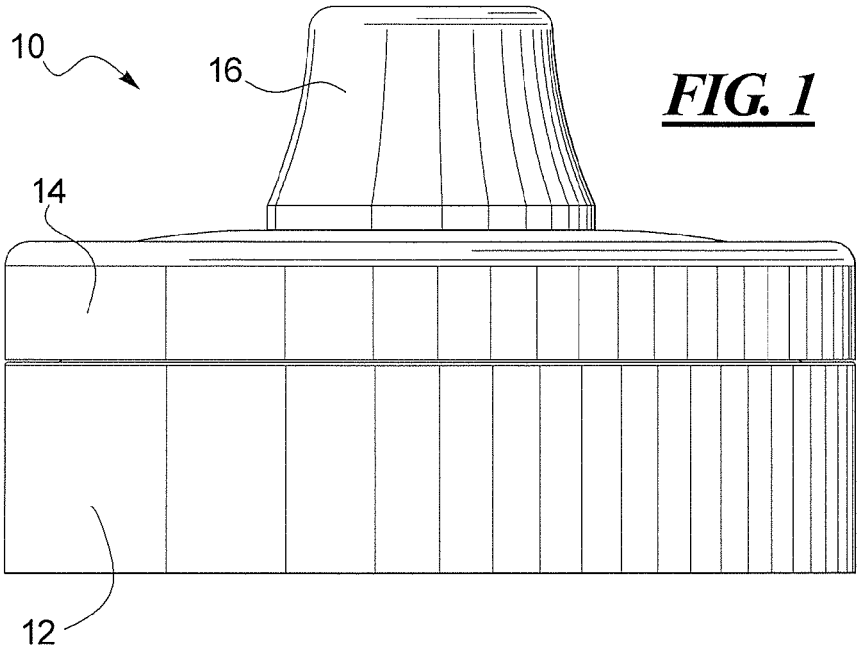
FIG. 1
FIG. 2
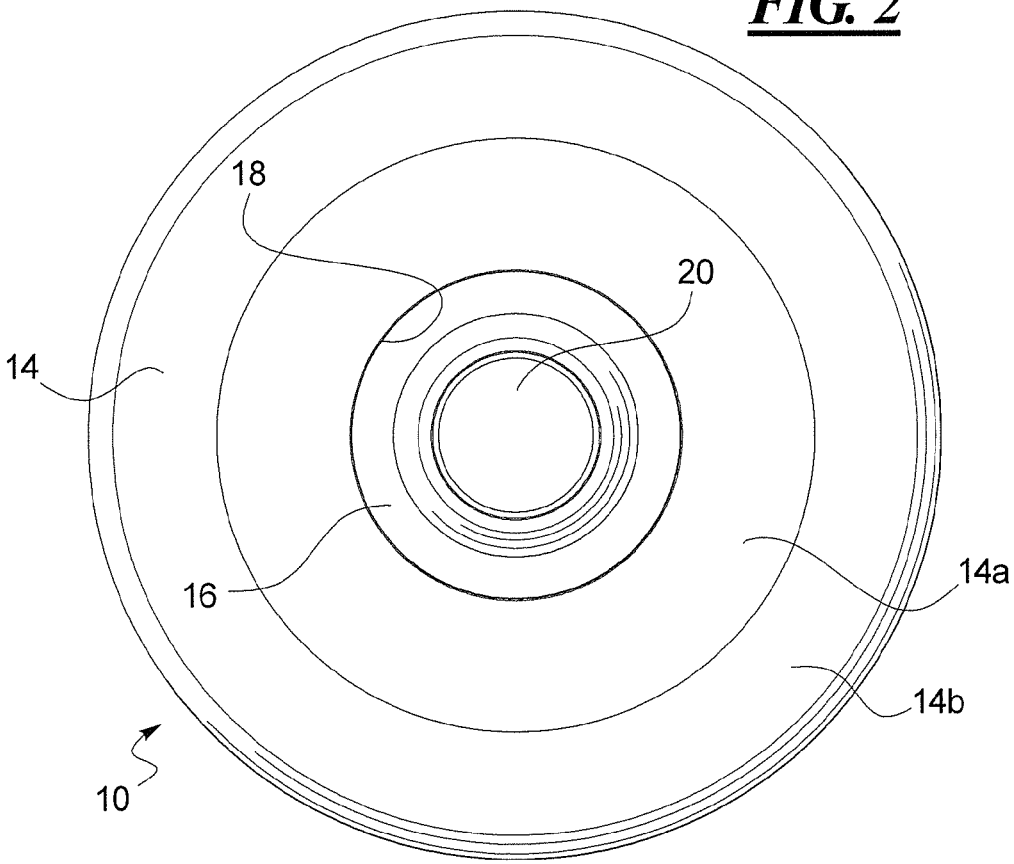

RESEALABLE BEVERAGE BOTTLE LID

BACKGROUND OF THE INVENTION

1. Field of the Invention

The present invention relates generally to a lid for a drink bottle, and more particularly to a drink bottle lid having a drinking nozzle that is selectively resealable.

2. Description of the Related Art

Beverage bottles are in some instances provided with a bottle lid having a drinking nozzle from which a user may drink without removing the lid from the bottle. One type of beverage bottle lid commonly used on sports bottles, such as bicycle water bottles, bottled water bottles, and other beverage bottles has a push/pull valve to open and close the fluid flow. The user must grasp the valve to pull it open and then that very valve is placed into the user's mouth for drinking. It is common to use this type of bottle when away from water sources so that the user has no opportunity to wash the user's hands before grasping the valve. Where the user's hands are soiled, such as with bicycle grease or dirt, the valve becomes soiled before being placed in the user's mouth. If the water bottle is being used during exercise in a gym, for instance, the user's hands are handling equipment used by a number of people and then contacting the drink nozzle to open and close the valve.

A sports beverage bottle that features a drinking nozzle with a valve that is opened and closed by rotating a control member is the Camelbak Jet Valve (a trademark of Camelbak). An inner cylinder having side openings is rotated in a cooperating outer cylinder of the lid that also has side openings to bring the openings into or out of registration so as to open or close the fluid valve. Rotation of the inner cylinder is accomplished by rotating two wing elements that extend from the base of the nozzle.

Other beverage bottles have removable lids that require the lid be removed to drink from the bottle, resulting in the lid becoming misplaced or lost during use.

SUMMARY OF THE INVENTION

The present invention provides a lid for a beverage bottle or other beverage container that has a drinking nozzle by which the user may drink the beverage contained in the bottle. The lid has a rotatable ring which when rotated causes the drinking nozzle to be selectively opened or closed. Rotation of the ring also rotates a spout which causes the spout to move axially relative to the rotating ring. Within the spout is a gasket that is pressed against a plug when the spout has been moved in a first direction to close a fluid passageway through the spout and that is moved away from the plug when the spout is moved in a second, opposite direction to open a fluid passageway through the spout.

The user does not contact the drinking spout when opening and closing the valve. The resealable lid provides a simple yet effective device that permits the user to drink from a beverage bottle without removing the lid while also providing a simple mechanism to seal the lid against leaks.

The actuation dial permits the user to easily move the valve part way between the fully open and fully closed position so as to vary the flow through the spout. The fluid flow may be varied to provide slower or faster flow rate from the lid. It is a simple matter to increase or decrease the flow rate by a little or a lot by turning the actuation dial accordingly.

The spout is mounted in the lid body in a recess within the lid body. The recess is covered by the actuation dial so that only the spout extends from the lid body, providing a compact resealable lid.

BRIEF DESCRIPTION OF THE DRAWINGS

FIG. 1 is a side elevational view of a twist locking seal lid according to the principles of the present invention;

FIG. 2 is a top plan view of the seal lid of FIG. 1;

DETAILED DESCRIPTION OF THE PREFERRED EMBODIMENTS

Figure 3:
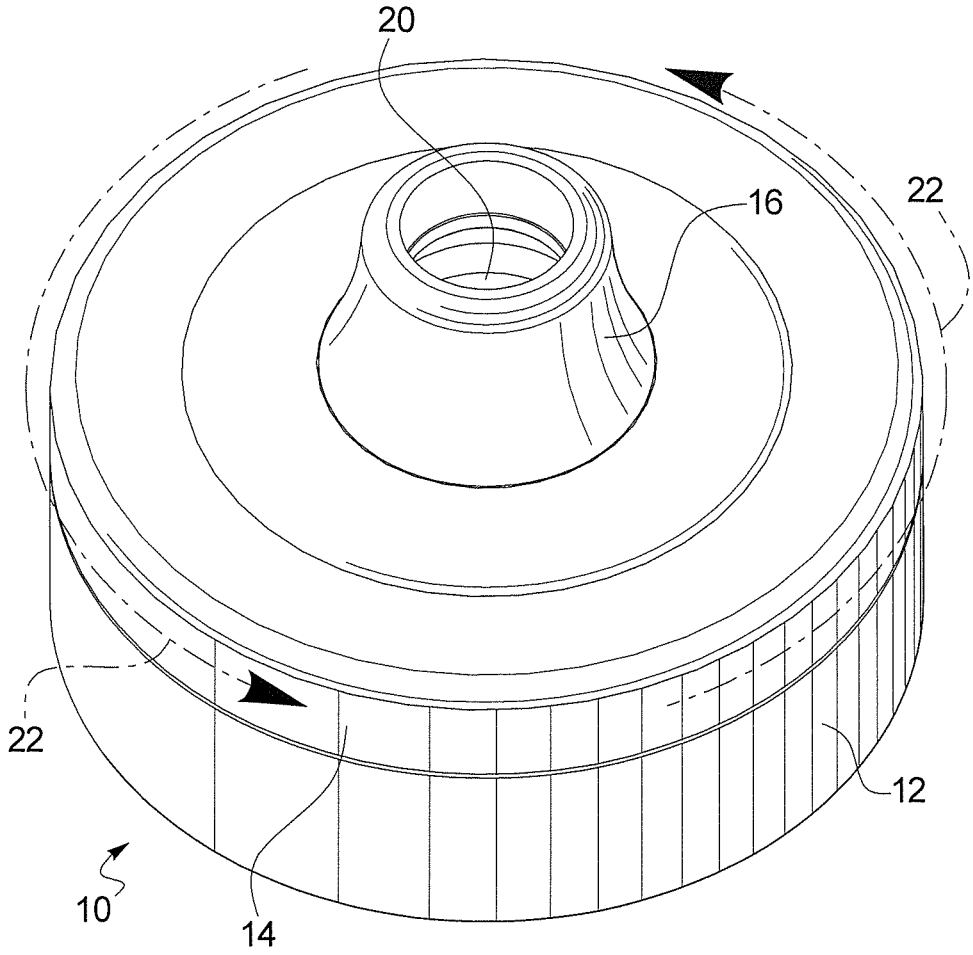
FIG. 3 is a top perspective view of the seal lid of FIG. 1.

A preferred embodiment of a twist lock seal lid 10 is shown in FIG. 1 including a lid body 12, an actuation dial 14 and a rotating spout 16. The lid body 12 may be fastened to a fluid container (not shown), such as a water bottle, juice bottle or other beverage container. The lid body 12 of the preferred embodiment is attached to the bottle or container by a threaded connection. However, it is contemplated to configure the lid body to attach to the bottle or beverage container by a snap closure connection, or pressure fit, or other connection or fastener, as will be understood by those of skill in the art. The spout 16 is exposed and projects from the lid body 12 so that the user may easily drink from the spout 16. It is contemplated in some embodiments to provide a cap or other cover over the spout 16 or over all or part of the lid body 12 to keep dirt and debris from the drinking spout 16.

In FIG. 2, the seal lid 10 is circular so that it may be threaded onto an opening of a beverage bottle or other beverage container. The top surface of the seal lid 10 is formed by the actuation dial 14 except for a central opening 18 in the actuation dial 14 through which the spout 16 extends. The spout 16 also has a central opening within which a plug 20 is provided. The actuation dial 14 may include an inner ring 14*a* of a first material and an outer ring 14*b* of a second material. For example, the inner ring 14*a* may be of a harder material and the outer ring 14*b* may be of a softer material for gripping.

Referring to FIG. 3, the seal lid 10 is opened and closed by rotating the actuation dial 14. In particular, the actuation dial 14 is rotated in a counter-clockwise direction as indicated by broken line arrows 22 to change the seal lid 10 from a closed or sealed position to an open position for drinking from the spout 16. During rotation of the actuation dial 14, the lid body 12 remains stationary, or at least the actuation dial 14 rotates relative to the lid body 12, regardless of whether one or the other remains stationary or not. Indicia may be provided on the actuation dial 14 to indicate that the dial 14 is to be rotated. The indicia may include arrows or other marks to indicate a direction of rotation for opening and a direction of rotation for closing the valve. Indicia including company logos, advertizing, fanciful designs and the like may be provided on the surfaces of the seal lid as well.

In one embodiment, the actuation dial 14 is rotated approximately 120 degrees between the fully open and closed positions. The flow rate through the lid 10 may be varied to less than the full open flow rate by moving the actuation dial 14 to a position between the fully open position and the closed position. If a greater or lesser flow rate is desired, adjustment of the actuation dial 14 in the corresponding direction accomplishes the desired flow rate. Rotation of the actuation dial 14 may require two handed operation, one hand to grip the lid body 12 and the other to rotate the dial 14. It is also possible that the actuation dial 14 may be rotated using a single hand when the lid body 12 is fastened tightly to a bottle and the bottle is secured against rotational movement.

The spout 16 may include an optional slit diaphragm valve (see FIG. 7) within the spout 16 to provide a seal against dirt and debris. One such diaphragm is provided by Liquid Molding Systems, Inc. (LMS), although others may be used instead.

Figure 4:
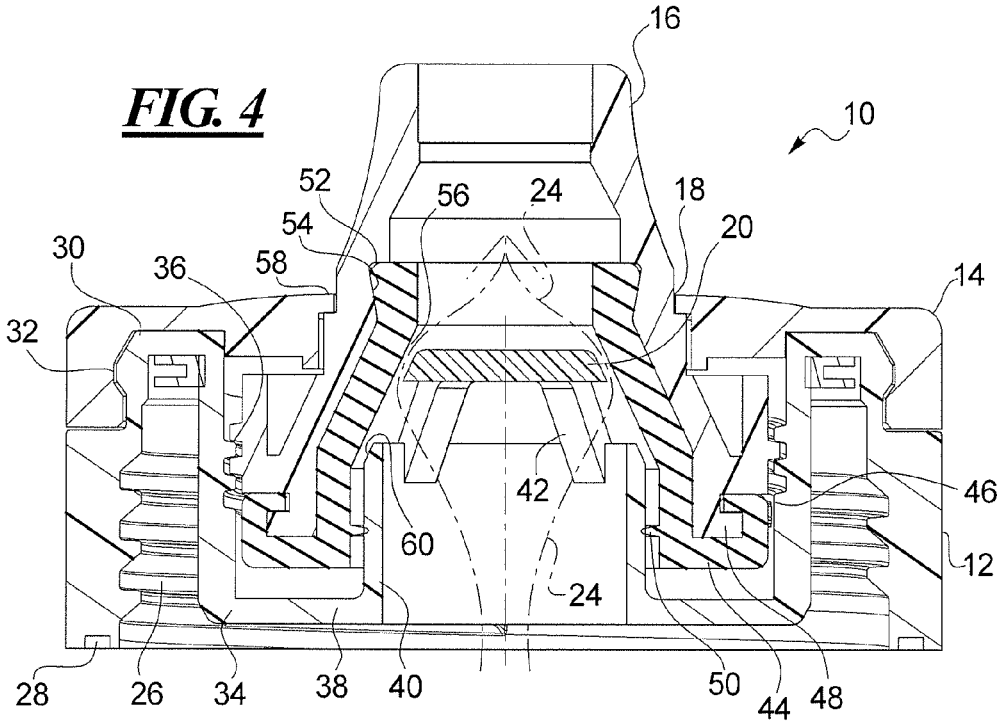
FIG. 4 is a cross-sectional view of the seal lid in an open position.

FIG. 4 shows the lid seal 10 in cross section in an open condition. The open condition of the lid seal 10 permits fluids to flow from an interior of a bottle or other beverage container (not shown) through the spout 16 as indicated by broken line arrows 24 so that the user may drink the beverage. The fluid flows from the bottle interior, around the outer perimeter of the plug 20 and through the central opening of the spout 16.

The view of FIG. 4 reveals internal structures within the lid seal 10. In particular, the lid body 12 is provided with threads 26 on an interior surface that engage cooperating threads on a bottle or other beverage container. The lid body 12 and the threads 26 are configured to fit the mouth of the bottle or container and may vary from the illustrated configuration. Where the bottle is configured for use with a snap-on lid, threads are not provided and instead a cooperating snap-on structure is provided within the lid body 12. Other attachment configurations are also possible and are within the scope of this invention. A recess 28 is formed into the lower surface of the lid body 12 to provide an engagement location for removing the mold from the threaded lid body 12, as is standard in molding of threaded parts.

The lid body 12 includes a circular dial mount 30. In the preferred embodiment the dial mount 30 is ring shaped, although other shapes are possible. The dial mount 30 includes a radial projection 32 over which the actuation dial 14 is fitted. The actuation dial 14 includes a corresponding recess to accommodate the radial projection 32, which prevents the actuation dial 14 from being removed from the lid body 12 but which has sufficient clearance to permit the actuation dial 14 to be rotated on the lid body 12, as indicated by the arrows 22 in FIG. 3.

Within the lid body 12 is a spout mounting portion 34 that has an interior threaded portion 36 within which the spout 16 is mounted. The spout mounting portion 34 is recessed within the lid body 12 so that the lid 10 has a low profile and provides a compact resealable lid for a beverage bottle. The spout mounting portion 34 also include a connecting ring 38 extending from the threaded portion 36 to a fluid flow tube 40. The plug 20 is mounted on supports 42 on the fluid flow tube 40. The supports 42 hold the plug 20 spaced from the end of the tube 40 to provide openings between the supports 42 through with the fluid flows when the user is drinking from the spout.

A gasket 44 is mounted within the spout 16. The gasket 44 includes a lower engagement portion 46 that engages a flange 48 on the lower end of the spout 16. A seal ring 50 extends from the interior of the gasket 44 into contact with the outer surface of the fluid flow tube 40 to prevent fluid leaks. An upper end 52 of the gasket 44 is flared outward as a projection that fits into a correspondingly shaped recess 54 within the spout 16. The interior surface of the gasket 44 is spaced from the plug 20 when the spout 16 is positioned as shown, leaving a fluid passageway 56 between the gasket 44 and the plug 20.

The actuation dial 14 extends to the outer surface of the spout 16. A lip 58 extends inwardly from the actuation dial 14 at the opening 18 to provide a surface against which a portion of the spout bears when the spout has reached the fully open position. The lip 58 stops the upward movement of the spout 16 during opening of the resealable lid 10.

Figure 5:
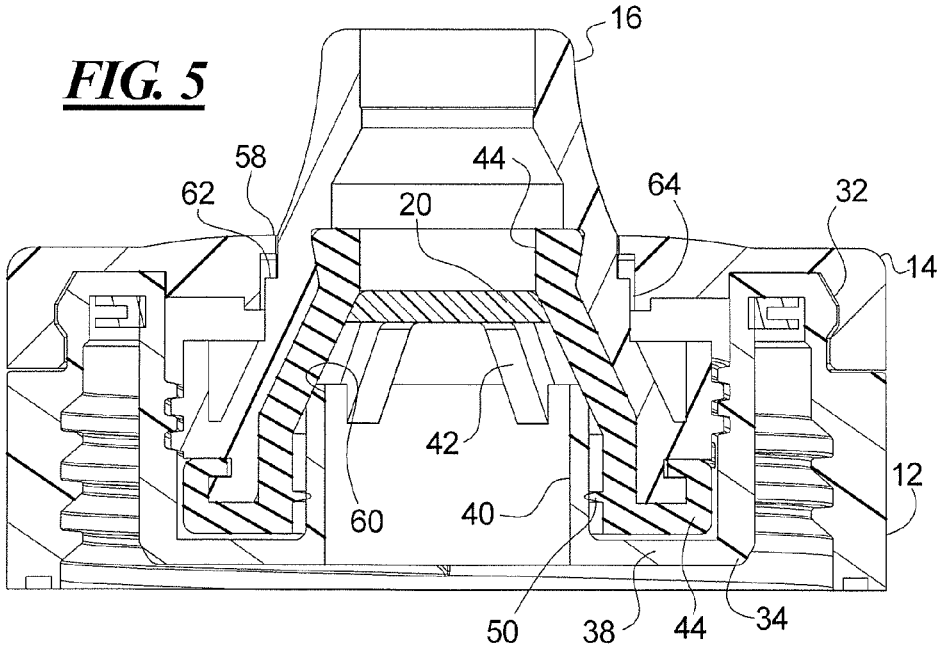
FIG. 5 is a cross sectional view of the seal lid in a closed position.

In FIG. 5 the lid 10 is in the closed or sealed position. This is accomplished by rotating the spout 16 in the lid body 12 so that the spout 16 moves downward into the lid body 12 as a result of being threaded on the threads 36 of the spout mounting portion 34. The downward movement of the spout 16 moves the interior surface of the gasket 44 against the outer edges of the plug 20 to form a seal. The passageway 56 for fluid flow is thereby closed. To ensure against leaks, the interior surface of the gasket 44 also bears against a tapered upper end 60 of the fluid flow tube 40. As noted previously, the seal ring 50 also bears against the fluid flow tube 40.

In the closed position, the spout 16 has been moved downward to define a gap between an outward projection of the spout 16 and the lip 58. A rotational engagement between the actuation dial 14 and the spout 16 is provided at 64, as will bee seen in the following figure.

The spout 16 includes external threads mounted on the internally threaded spout mounting portion 34 for axial movement between the open and closed positions. In an alternate embodiment, the spout may include internal threads that threadably engage an externally threaded fluid flow tube, similar to the tube 40, for axial movement of the spout. In such embodiment, the gasket is reconfigured to permit the threaded engagement. Gaskets of different shapes and configurations are within the scope of the present invention.

Figure 6:
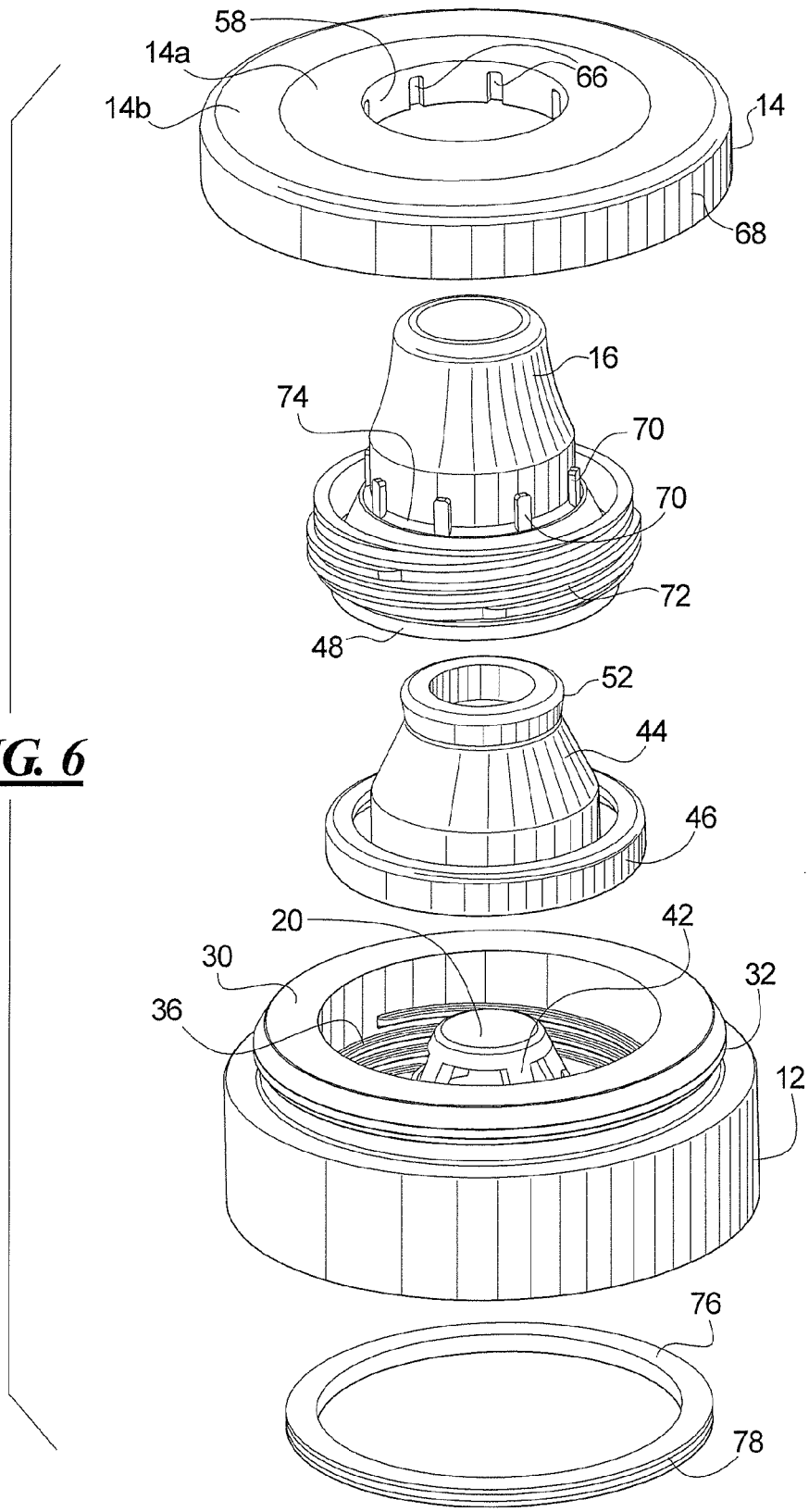
FIG. 6 is an exploded view of the seal lid.

Turning to FIG. 6, an exploded view shows the actuation dial 14 with channels 66 formed in an interior surface of the central opening 18. An outer edge 68 of the actuation dial 14 may be smooth as illustrated or knurled, grooved or otherwise provided with a grip enhancing characteristic. In a preferred embodiment, the outer edge 68 is formed of a soft plastic material that enhances gripping of the actuation dial for turning.

The spout 16 includes an arrangement of teeth 70 that fit into the channels 66. The teeth 70 ensure that the spout 16 rotates when the actuation dial 14 is rotated. The spout 16 includes threads 72 that engage the threads 36 of the lid body 12 so that rotation of the spout 16 moves the spout axially within the lid body 12. The teeth 70 slide axially within the channels 66 of the actuation dial 14 to permit axial movement of the spout 16 within the rotating actuation dial 14. At the base of the teeth 70 is the projection 74 which abuts the lip 58 on the actuation dial 14 to serve as a stop to prevent turning of the actuation dial 14 beyond a fully open position.

The gasket 44 which is mounted to the spout 16 includes the outwardly flared upper end 52 and the lower engagement portion 46. These structures ensure that the gasket 44 moves with the spout 16 as the spout 16 is rotated to move between the open and closed position.

The lid body 12 includes the dial mount 30 with the projection 32 that holds the actuation dial 14 in place while permitting the actuation dial to rotate on the lid body 12. The interior threads 36 in the lid body 12 engage the threads 72 on the exterior of the spout 16. The plug 20 on the supports 42 is within the center of the lid body 12. The plug 20 has a beveled edge for bearing against the interior of the gasket 44 when the lid 10 is in the sealed condition.

A circular gasket 76 may be provided to provide an improved seal between the lid body 12 and the mouth of the bottle, if desired. The circular gasket 76 fits within the lid body 12, such as within the hollow interior of the circular dial mount 30. The gasket may be solid or formed with a channel 78 as shown.

The present lid is relatively simple to assemble during manufacture, for example by affixing the gasket 44 to the spout 16, threading the spout 16 onto the threads 36 in the lid body 12, and snapping the actuation dial 14 onto the dial mount 30 of the lid body 12 while assuring that the teeth 70 fit into the channels 66. Where the circular gasket 76 is used, it is fit into the lid body 12. Cleaning of the seal lid 10 is simple as the fluid is generally prevented form reaching inaccessible spaces within the lid by seals and cleaning can generally be accomplished without disassembly. However, should extensive cleaning be required, the seal lid 10 is relatively easily disassembled by prying the actuation dial 14 from the lid body 12 and unthreading the spout 16 from the lid body 12. Reassembly follows the steps described above.

Figure 7:
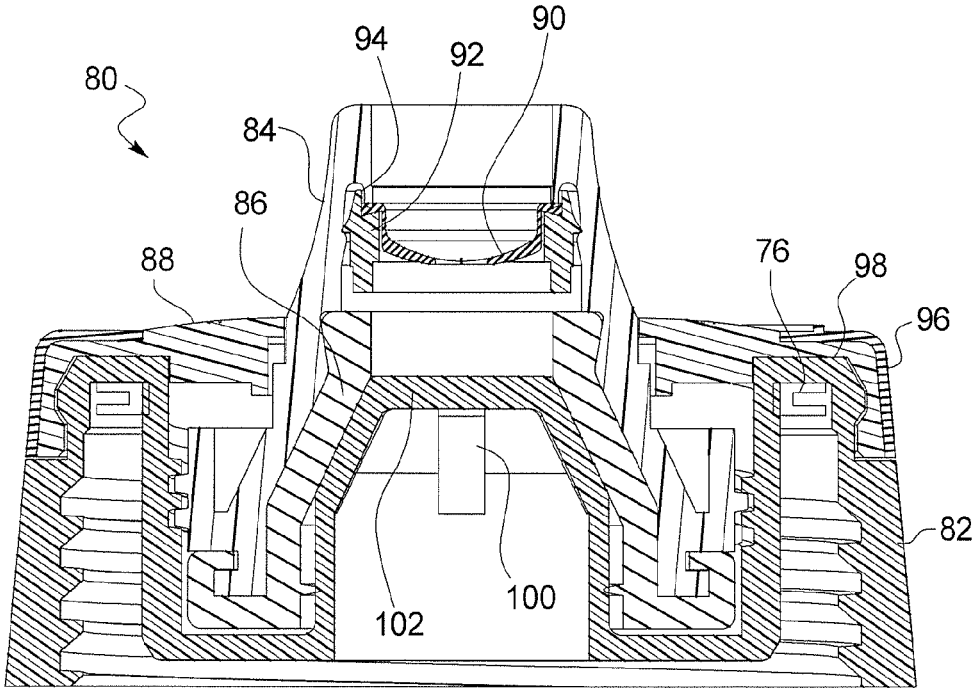
FIG. 7 is cross-sectional view of an alternate embodiment of the seal lid according to the invention.

Turning to FIG. 7, an alternative embodiment of the seal lid 80 retains the same basic structure as the embodiment described above, including a lid body 82, a spout 84 threaded into the lid body, a gasket 86 affixed in the spout 84, and an actuation dial 88 affixed on the lid body 82. An added element is a slit diaphragm 90 extending over the opening of the spout 84. The diaphragm 90 is flexible and has one or more central slits that open to permit fluid to flow through the diaphragm when the user squeezes the bottle or applies suction to the spout 84. Release of the pressure or suction permits the diaphragm to return to a closed state, keeping drips of the beverage from leaving the spout 84 and preventing dirt and dust from entering the bottle. The slit diaphragm 90 is supported on a diaphragm ring 92 that is fit into a channel 94 within the spout 84. The channel 94 and ring 92 are configured to retain the diaphragm 90 in position, although the diaphragm may be removed from the spout 84 after disassembly of the lid body.

The actuation dial 88 of the second embodiment includes a cover 96 over the grip surfaces that are engaged by the user during rotation of the dial. The cover 96 may be of a grip enhancing material, such as a soft rubber, or may be of a color or texture contrasting material compared to the material of the actuation dial. The preferred cover 96 is of a soft rubber extending over the outer cylindrical surface and over a portion of the top surface of the actuation dial 88.

The gasket 76 is shown within the dial mounting portion 98 of the lid body 82. The view of FIG. 7 is taken through two of the supports 100 that hold the stop 102 and between which are defined spaces that provide the fluid flow path when the seal lid 80 is in the open condition. The lid 80 of FIG. 7 is shown in the closed, or sealed, position.

The components of the present invention may be formed of a variety of materials. In a preferred embodiment, the spout and lid body are formed of a hard or semi-hard plastic, the actuation dial is formed of a softer plastic material that is more readily gripped without slipping, while the gasket is formed of a rubber or deformable soft plastic or elastomeric material to promote sealing of the valve. The surfaces of the components may have textures to facilitate gripping. It is contemplated that the gasket may be formed as a coating on the interior of the spout or as a separate element that is affixed to the spout. The gasket may be separate from the spout. It is also contemplated that the gasket and spout may be formed in one piece of a single material, for example of a material which has sufficient structural strength to rotate on the treads of the lid body while also having sufficient resilience to seal against the plug.

The spout 16 provides a nozzle from which a user may drink the beverage contained within the bottle or other container. The user may place their mouth directly on the spout and apply suction to draw the liquid into the user's mouth, or the bottle may be squeezed to force the fluid through the spout. The lid is not limited to use for beverages but may be provided on fluid containers, for example, for watering plants, spraying liquids for cleaning, or otherwise dispensing liquids.

The terms upward and downward are used herein for ease of understanding with reference to the drawings and do not limit the orientation or movement of embodiments of the present invention or the scope of the claims.

Although other modifications and changes may be suggested by those skilled in the art, it is the intention of the inventors to embody within the patent warranted hereon all changes and modifications as reasonably and properly come within the scope of their contribution to the art.

I claim:

1. A resealable lid for a fluid container, comprising:

a lid body having a first portion for attachment to the fluid container, said lid body including a spout mounting portion and a plug;

an actuation dial mounted on said lid body and being rotatable thereon, said actuation dial including a central opening having an engagement portion;

a spout mounted in said spout mounting portion of said lid body and having a spout portion extending through said central opening of said actuation dial, said spout being threadably engaged to said spout mounting portion, said spout being connected to said engagement portion so that rotation of said actuation dial rotationally drives said spout, said connection between said spout and said engagement portion permitting said spout to move axially relative to said actuation dial during rotation of said actuation dial to change said resealable lid between a sealed condition and an open condition; and a gasket within said spout, said gasket bearing against said plug when said resealable lid is in the sealed condition, said spout defining a fluid passageway between said plug and said gasket when said resealable lid is in the open condition.

2. A resealable lid as claimed in claim 1, wherein said engagement portion of said actuation dial includes axial channels at said central opening, and wherein said spout includes axially extending teeth in said axial channels.

3. A resealable lid as claimed in claim 1, wherein said plug includes a circular plug member connected by supports to said spout mounting portion of said lid body.

4. A resealable lid as claimed in claim 1, wherein said gasket is a separate member from said spout and is mounted in said spout.

5. A resealable lid as claimed in claim 4, wherein said gasket is affixed to an end of said spout within said lid body and extends inside said spout to a position to bear against said plug in said closed position.

6. A resealable lid as claimed in claim 1, further comprising a slit diaphragm within said spout.

7. A lid for a beverage bottle having a threaded opening, comprising:

a lid body including a threaded portion capable of threaded engagement on the threaded opening of the beverage bottle, said lid body including a threaded spout mounting portion, said threaded spout mounting portion being recessed within said lid body, a plug mounted within said threaded spout mounting portion, said plug being connected to said threaded spout mounting portion by supports defining at least one fluid flow opening;

a rotatable spout including a threaded portion threaded to said threaded spout mounting portion, said plug being disposed within said spout;

an actuation dial mounted on said lid body and rotatable between first and second positions, said actuation dial connected to said rotatable spout to rotate said rotatable spout on said threaded spout mounting portion, said first position of said actuation dial sealing said rotatable spout against said plug, said second position of said actuation dial spacing said rotatable spout from said plug to define a fluid flow opening; and a gasket mounted within said rotatable spout and disposed between said rotatable spout and said plug so as to be brought into sealing engagement with said plug in said first position of said actuation dial.

8. A lid as claimed in claim 7, wherein said threaded spout mounting portion is internally threaded, and wherein said rotatable spout is externally threaded for threaded engagement with said threaded spout mounting portion.

9. A lid as claimed in claim 7, wherein said lid body includes a dial mount, said actuation dial is mounted on said dial mount and is rotatable thereon.

10. A lid as claimed in claim 7, wherein said rotatable spout includes a flange, and wherein said gasket is mounted on said flange.

11. A lid as claimed in claim 10, wherein said rotatable spout includes a recess spaced from said flange, wherein said gasket includes a projection that is fit into said recess, and wherein said gasket extends between said recess and said flange.

12. A lid as claimed in claim 7, wherein said gasket includes a lip projecting into engagement with said lid body to provide a fluid seal regardless of whether said actuation dial is in said first position or said second position.

13. A lid as claimed in claim 12, wherein said lid body includes a fluid flow tube, and wherein said lip of said gasket bears against an exterior cylindrical surface of said fluid flow tube.

14. A lid for a beverage bottle having a threaded opening, comprising:

a lid body including a threaded portion capable of threaded engagement on the threaded opening of the beverage bottle, said lid body including a threaded spout mounting portion, said threaded spout mounting portion being recessed within said lid body, a plug mounted with said threaded spout mounting portion, said plug being connected to said threaded spout mounting portion by supports defining at least one fluid flow opening;

a rotatable spout including a threaded portion threaded to said threaded spout mounting portion, said plug being disposed within said spout;

an actuation dial mounted on said lid body and rotatable between first and second positions, said actuation dial connected to said rotatable spout to rotate said rotatable spout on said threaded spout mounting portion, said first position of said actuation dial sealing said rotatable spout against said plug, said second position of said actuation dial spacing said rotatable spout from said plug to define a fluid flow opening;

wherein said rotatable spout includes a plurality of teeth, and wherein said actuation dial includes recesses engaged with said plurality of teeth so that rotation of said actuation dial also rotates said rotatable spout, but axial movement of said rotatable spout does not result in axial movement of said actuation dial.

15. A resealable lid to permit a user to drink from a beverage bottle having a threaded bottle mouth, comprising:

a lid body having a first internally threaded portion configured for threaded engagement on the threaded bottle mouth of the beverage bottle;

a spout mounting portion of said lid body including a second internally threaded portion, said spout mounting portion being recessed within said first internally threaded portion;

a connecting ring extending from said spout mounting portion;

a fluid flow tube connected to said connecting ring, said fluid flow tube being substantially coaxial with said lid body and said spout mounting portion, said fluid flow tube being recessed within said lid body;

a plurality of supports connected to said fluid flow tube;

a plug connected to said supports and spaced from said fluid flow tube to define a plurality of fluid flow openings between said supports, said plug being recessed within said lid body;

a dial mounting ring of said lid body including a radial projection;

said lid body and said spout mounting portion and said connecting ring and said fluid flow tube and said plurality of supports and said plug and said dial mounting ring being molded in one piece;

a rotatable spout having an externally threaded spout portion threadably engaged with said second internally threaded portion of said spout mounting portion, said rotatable spout including a central opening within which is disposed said plug, said rotatable spout including a projecting spout end, said externally threaded spout portion being recessed within said lid body and said projecting spout end projecting from said lid body;

a flange on said rotatable spout body;

a gasket mounted on said flange of said spout body, said gasket including a sealing portion disposed between said rotatable spout and said plug;

a seal lip extending from said gasket into contact with said fluid flow tube;

a plurality of teeth on said rotatable spout body; and an actuation dial mounted on said dial mounting ring of said lid body and engaged with said plurality of teeth of said rotatable spout, said actuation dial being rotatable on said lid body, said engagement of said actuation dial with said plurality of teeth of said rotatable spout causing rotation of said rotating spout during rotation of said actuation dial, said engagement of said actuation dial with said rotatable spout being structured to permit axial movement of said rotating spout relative to said actuation dial during rotation of said actuation dial.

* * * * *